US006698112B2

(12) United States Patent
Grobler et al.

(10) Patent No.: US 6,698,112 B2
(45) Date of Patent: Mar. 2, 2004

(54) COURSE-GROOMING VEHICLE WITH A REAR TOOL CARRIER

(75) Inventors: Hendrik Grobler, Llaupheim (DE); Helmut Kanzler, Illerberg (DE)

(73) Assignee: Kässbohrer Geländefahrzeug AG, Senden (DE)

( * ) Notice: Subject to any disclaimer, the term of this patent is extended or adjusted under 35 U.S.C. 154(b) by 0 days.

(21) Appl. No.: 10/219,709

(22) Filed: Aug. 15, 2002

(65) Prior Publication Data

US 2003/0070325 A1 Apr. 17, 2003

(30) Foreign Application Priority Data

Aug. 17, 2001 (DE) ..... 101 41 155

(51) Int. Cl.[7] ..... E01H 4/02
(52) U.S. Cl. ..... 37/219; 172/4.5
(58) Field of Search ..... 37/196, 219, 222; 172/4.5, 7, 10

(56) References Cited

U.S. PATENT DOCUMENTS 5,632,106 A 5/1997 Sinykin ..... 37/222
2002/0156571 A1 * 10/2002 Fortin ..... 701/213
2003/0051376 A1 * 3/2003 Lassonde et al. ..... 37/348

FOREIGN PATENT DOCUMENTS

DE 100 45 524 A 1 3/2002 ..... 4/2
WO WO 01/55511 A2 8/2001

* cited by examiner

*Primary Examiner*—Thomas B. Will
*Assistant Examiner*—Alexandra K. Pechhold
(74) *Attorney, Agent, or Firm*—Greenberg Traurig

(57) ABSTRACT

A course-grooming vehicle with a rear tool carrier, to which a course-grooming device can be detachably connected, where the height and/or the angle of the rear tool carrier and/or of the course-grooming device can be varied by means of at least one adjusting element, and with an electronic control unit, which actuates the minimum of one adjusting element, is known. At least one sensor for the direct or indirect detection of an actual state of the surface of the course to be groomed by the course-grooming device is provided, which sensor is connected to the control unit, the control unit comprising a memory for storing at least one characteristic diagram and an evaluation unit, which compares the actual values detected by the sensor with corresponding nominal values of the characteristic diagram and which, as a function of the result of the evaluation, actuates the minimum of one adjusting element accordingly.

11 Claims, 1 Drawing Sheet

COURSE-GROOMING VEHICLE WITH A REAR TOOL CARRIER

BACKGROUND OF THE DISCLOSURE

1. Field of the Invention

The invention pertains to a course-grooming vehicle with a rear tool carrier, on which a course-grooming device is detachably connected, where the height and/or angle of the rear tool carrier and/or of the course-grooming device can be varied by means of at least one adjusting element.

2. Background Art

These types of course-grooming vehicles are known in general for the upkeep of ski slopes. A known course-grooming vehicle has a rear tool carrier, to which a course-grooming device can be detachably connected. A type of course-grooming device which is known for the preparation of ski slopes is in particular the snow propeller, which is combined with a smoothing device, also referred to as a "finisher", which is connected behind the propeller. The position of the rear tool carrier can be varied by means of one or more adjusting cylinders, especially hydraulic cylinders. The minimum of one adjusting cylinder is driven by hydraulic control means, which are actuated by an electronic control unit. The appropriate control commands are issued manually via operating and control levers in the driver's cabin. The driver of the course-grooming vehicle must have a great deal of experience in operating the control lever so that the course will be groomed uniformly even in cases of uneven ground, steep downslopes, steep upslopes, and rounded summits.

SUMMARY OF THE INVENTION

The task of the invention is to create a course-grooming vehicle of the general type indicated above which makes it possible for a course to be groomed uniformly even without a great deal of experience on the part of the human operator.

This task is accomplished in that at least one sensor for directly or indirectly detecting the actual state of the surface of the course to be groomed by the course-grooming device is provided, which sensor is attached to the control unit, and in that the control unit comprises, first, a memory for holding at least one characteristic diagram for various configurations of the course surface and the associated nominal settings for the height and/or angle of the rear course-grooming device and, second, an evaluation circuit, which compares the actual values detected by the sensor with corresponding nominal values from the characteristic diagram and accordingly actuates the minimum of one adjusting element as a function of the result of the evaluation. As sensors for the direct detection of the surface of the course, sensors which scan the surface of the course directly and which can operate either with or without contact can be provided. As sensors for the indirect detection of the surface of the course, position, force, or distance sensors, which are mounted in the area of the rear tool carrier, on the vehicle, or in the area of the course-grooming device in question, are provided. The characteristic diagram for the various configurations of the course surface and suitable nominal settings for the grooming processes in question are preferably determined empirically by using "dry" settings for the various grooming conditions. Relevant operating or grooming conditions, especially for a course-grooming device in the form of a snow propeller followed by a smoothing device, include, for example, a flat course, the transition from a flat course to a downslope or to an upslope, the traversing of a rounded summit, and the situation in which a front-mounted implement is lifted from the snow, as a result of which the entire the front end of the course-grooming vehicle is lowered slightly by the intrinsic weight of the implement and simultaneously the rear of the vehicle is raised. In all these cases, the propeller would dig too deeply into the base unless the control device were actuated to compensate. In the absence of such compensation, it would not be possible for the course to be groomed uniformly. As a result of the solution according to the invention, however, the configuration of the course is always determined, and automatic adjustments are made by the control unit according to the desired parameter settings without the need for manual intervention by the driver or operator of the course-grooming vehicle. Thus automatic control can be easily achieved. The solution according to the invention is especially suitable for chain-driven course-grooming vehicles for the maintenance and grooming of ski slopes. A course-grooming vehicle of this type, however, can also be used for courses consisting of sand, gravel, grass, or earth.

In an embodiment of the invention, an adjusting cylinder, especially a hydraulic cylinder, is provided as the adjusting element, which is hinged to the vehicle. This design is especially advantageous for the type of chain-driven course-grooming vehicle which is used on snow-covered ski slopes.

In a further embodiment of the invention, at least one adjusting cylinder is switched into a "floating" or passive state during the course-grooming operation, and a force-measuring or distance-measuring sensor is assigned to the adjusting cylinder as an indirect detection sensor. As a result of the concomitant movement of the floating adjusting cylinder, any change in the position of the course-grooming device or of the rear tool carrier results in relative movement between the part hinged to the vehicle and the part hinged to the rear tool carrier or course-grooming device, that is, between the cylinder and the piston. This relative movement represents a parameter of the corresponding change in position, which means that a corresponding sensor signal is available for processing by the electronic control unit. In a design in which a hydraulic cylinder is used as the adjusting element, the cylinder is preferably actuated by at least one hydraulic control element, which is connected to the electronic control unit.

In a further embodiment of the invention, a force sensor is assigned to the adjusting cylinder as an indirect detection sensor. In particular, it is possible to provide a sensor which can detect the increases and decreases in the pressure in a hydraulic circuit of the associated adjusting cylinder which are caused by corresponding shifts in the position of the rear tool carrier or of the course-grooming device.

As an indirect sensor for detecting the actual state of the course surface to be groomed, it is also possible to attach an angle or position sensor permanently to the area of the rear tool carrier or course-grooming device or possibly also directly to a stationary point on the vehicle.

BRIEF DESCRIPTION OF THE DRAWINGS

Additional advantages and features of the invention can be derived from the claims and from the following description of a preferred exemplary embodiment of the invention, which is illustrated in the drawings:

DETAILED DESCRIPTION OF THE DRAWINGS

Figure 1:
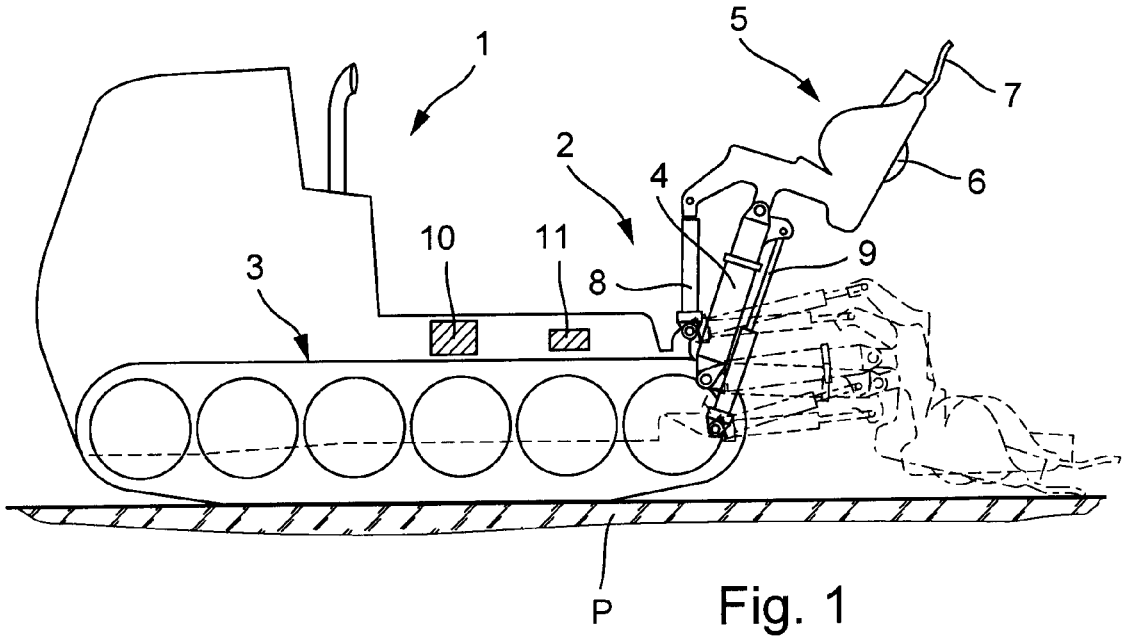
FIG. 1 shows a schematic side view of an embodiment of a course-grooming vehicle according to the invention with a rear tool carrier, to which a course-grooming device in the form of a snow propeller is connected.
Figure 2:
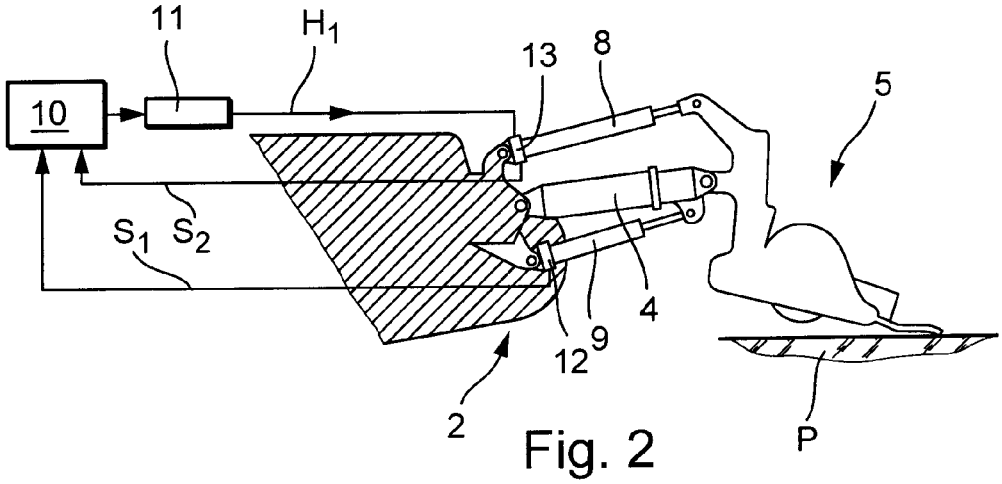
FIG. 2 shows a schematic diagram of the rear area of the course-grooming vehicle according to FIG. 1, where the rear tool carrier and the snow propeller are oriented in a position which is suitable for grooming a rounded summit.

A course-grooming vehicle 1 according to FIGS. 1 and 2 is provided on each of its two opposite sides with a track-laying drive mechanism 3, which means that the course-grooming vehicle 1 is chain-driven. The course-grooming vehicle 1 can be used in particular on snow-covered ski slopes.

At the rear 2 of the vehicle, a rear tool carrier 4 is provided in a manner known basically in and of itself, to which a rear course-grooming device 5 is attached by suitable joints. In the exemplary embodiment shown here, the course-grooming device 5 consists of a snow propeller 6, followed by a smoothing device 7. A course-grooming device of this type is generally known in and of itself, so that there is no need to discuss it further here.

The height and the angle of the rear tool carrier 4 and of the course-grooming device 5 can be varied by two hydraulic adjusting cylinders 8, 9. A lower hydraulic adjusting cylinder 9 acts on the rear tool carrier 4. The upper adjusting cylinder 8 acts on a connecting extension of the course-grooming device 5. The two adjusting cylinders 8, 9 are hinged to the rear 2 of the vehicle. The two adjusting cylinders 8, 9 are actuated by hydraulic control means, although only the hydraulic control means 11 for the upper adjusting cylinder 8 is shown in FIGS. 1 and 2. The hydraulic control means are actuated by an electronic control unit 10, which is provided with a memory unit, in which a characteristic diagram of the various possible configurations of the surface of the course and the associated nominal settings for the height and/or the angle of the course-grooming unit 5 are stored. In addition, the electronic control unit 10 also comprises an evaluation circuit, to be described in greater detail below, which actuates the hydraulic control means as a function of the results of the nominal-actual comparison.

A distance sensor 12 is integrated into the lower adjusting cylinder 9 for the indirect detection of the actual condition of the course surface P. The distance sensor 12 is connected by a signal line $S_1$ to the electronic control unit. The distance sensor 12 transmits the actual values of the relative displacement between the cylinder part hinged to the vehicle and the piston part of the adjusting cylinder 9 hinged to the tool carrier. Defined positions of the rear tool carrier 4 and of the course-grooming device 5 are assigned to each value for the displacement between the two parts of the lower adjusting cylinder 9.

In dashed line, FIG. 1 shows the normal, floating position of the course-grooming device 5 suitable for the grooming of a flat course. The orientation of the course-grooming device 5 for the grooming of a rounded summit is shown in dash-dot line. It is important in this case for the smoothing device to dig into the surface of the course to provide a support point for the course-grooming device 5.

The evaluation circuit of the control unit 10 sends an appropriate control command to the hydraulic control element 11 for the upper adjusting cylinder 8 as a function of the corresponding nominal/actual value comparison, as a result of which this cylinder is extended or retracted via the hydraulic control line $H_1$ in a manner suitable for achieving the desired position and angle of the course-grooming device 5.

In the exemplary embodiment illustrated, a distance sensor 13 is also integrated into the upper adjusting cylinder 5, this sensor being connected to the electronic control unit 10 by an additional signal line $S_2$. As a result, the upper adjusting cylinder 8 can be controlled automatically, because the distance sensor 13 provides feedback to the control unit 10 concerning the actual distance by which the upper adjusting cylinder 8 was extended or retracted. In addition, the installation of an additional distance sensor 13 also means that this distance sensor 13 can be used alternatively for the indirect detection of the actual values of the course surface P to be groomed.

So that the distance sensors 12, 13 for the two adjusting cylinders 8, 9 will function correctly for the indirect detection of the actual state of the surface P of the course to be groomed, it is necessary for the associated adjusting cylinder to be in a floating, that is, passive, state. The cylinder therefore may not be under any pressure but rather must allow the piston part to move back and forth without constraint.

What is claimed is:

1. A course-grooming vehicle having a rear-tool carrier, a course-grooming device, detachably connected to the rear tool carrier, at least one adjusting element, an electronic control unit, capable of actuating the at least one adjusting element to influence a height and/or an angle of the rear tool carrier and/or of the course-grooming device, at least one sensor for the direct or indirect detection of an actual state of a course surface of a course to be groomed by the course-grooming device, a memory, wherein said memory includes at least one characteristic diagram for various configurations of the course surface and associated nominal settings for the height and/or angle of the course-grooming device and an evaluation circuit, wherein said evaluation circuit is capable of comparing actual values detected by the sensor with the corresponding nominal values of said characteristic diagram and correspondingly actuating the at least one adjusting element.

2. The course-grooming vehicle according to claim 1, wherein the at least one adjusting element is an adjusting cylinder.

3. The course-grooming vehicle according to claim 2, wherein the adjusting cylinder is a hydraulic cylinder, hingedly attached to the vehicle.

4. The course-grooming vehicle according to claim 2, wherein the at least one adjusting cylinder is connected in such a way as to be floating, in a passive manner, during the course-grooming operation, and in that a distance sensor is assigned to the adjusting cylinder to serve as an indirect detection sensor.

5. The course-grooming vehicle according to claim 4, wherein the distance sensor is integrated into the at least one adjusting cylinder.

6. The course-grooming vehicle according to claim 2, wherein a force sensor is assigned to the at least one adjusting cylinder.

7. The course-grooming vehicle according to claim 6, wherein the force sensor is integrated into the at least one adjusting cylinder.

8. The course-grooming vehicle according to claim 6, wherein a scanning sensor, which can be brought into contact with the surface of the course is provided as a direct detection sensor.

9. The course-grooming vehicle according to claim 8, wherein the scanning sensor is one of: a force sensor, a distance sensor.

10. The course-grooming vehicle according to claim 1, wherein a sensor which works without contact is provided as a direct sensor.

11. The course-grooming vehicle according to claim 1, wherein an angle or position sensor is provided in the area of the rear tool carrier of the course-grooming device.

* * * * *